US006019339A

United States Patent [19]

Brayford

[11] Patent Number: 6,019,339

[45] Date of Patent: Feb. 1, 2000

[54] BOOK HOLDER

[76] Inventor: Myrna Brayford, 47 Walnut St., Box 701, Alliston, Canada, L9R 1V9

[21] Appl. No.: 09/025,795

[22] Filed: Feb. 19, 1998

Related U.S. Application Data

[60] Provisional application No. 60/038,637, Feb. 19, 1997.

[51] Int. Cl.[7] ..... A47B 5/04; A47B 23/00

[52] U.S. Cl. ..... 248/444.1; 248/445; 281/42

[58] Field of Search ..... 248/445, 444.1, 248/451, 452; 281/42, 45, 15.1, 51; 24/336, 67 R, 67.3, 67.9; 116/234; 40/352

[56] References Cited

U.S. PATENT DOCUMENTS

| | | | |
|---|---|---|---|
| 1,603,504 | 10/1926 | Baltzley | 24/563 |
| 1,675,286 | 6/1928 | Valkenburg | 24/563 |
| 2,606,042 | 8/1952 | Freber | 281/42 |
| 3,593,955 | 7/1971 | Hind . | |
| 3,809,352 | 5/1974 | Mathias | 248/441 |
| 3,833,197 | 9/1974 | Dyke | 248/441 |
| 3,897,037 | 7/1975 | Johnson et al. | 248/460 |
| 3,981,522 | 9/1976 | Bloom . | |
| 4,170,052 | 10/1979 | Okerblom | 24/67.9 |
| 5,082,229 | 1/1992 | Dahl | 248/444.1 |
| 5,165,648 | 11/1992 | Quigley . | |
| 5,165,723 | 11/1992 | Evans . | |
| 5,246,251 | 9/1993 | Evans . | |

*Primary Examiner*—Derek J. Berger
*Assistant Examiner*—Michael D. Nornberg

[57] ABSTRACT

A flexible resilient book holder which permits an open book to be placed between a first and second planar surface keeping the pages on each side of the book in a relatively flat plane to permit the reader to read both pages.

10 Claims, 3 Drawing Sheets

BOOK HOLDER

The present application claims priority from provisional application No. 60/038,637 filed Feb. 19, 1997.

FIELD OF INVENTION

The present invention is directed to a book holder. In particular, the present invention is directed to a book holder which can be used to hold and maintain a book in an opened position.

BACKGROUND OF INVENTION

It is often desirable for a book to be opened, and remain open, without having to manually hold the book open. However, many books, in particular, books which have not been used often, have bindings which will not consistently allow the book to be opened, and remain open, at a desired place. Moreover, with large textbooks and the like, it is often required to open a book so that one side of the splayed open books is much thicker than the other side. Consequently, in the design of a book holding device to hold a book open, it is advantageous to provide a device which is capable of holding open a thicker side of the book while not overly affecting the resilient operation of the side of the device corresponding to the thinner side of the book and thereby also holding open the thinner side of the opened book.

There have been a number of prior art patents for book holders. U.S. Pat. Nos. 5,246,251 and 5,165,723 both to Evans, describe a book holder with an elongate panel having a U-shaped end at opposite ends of the panel. The elongate panel is placed horizontally on the back of the book with each U-shaped end wrapping around the outside of each side of the book, trapping the pages between the overhang of the U-shaped end and the elongate panel. The elongated panel may be extensibly adjusted for different book widths.

U.S. Pat. No. 3,981,522 describes a book holder for enclosing and holding books. A spring element comprising a resilient strip is used across the front of the book holder to hold the book holder and the book in a substantially flat, open position. Again, the resilient strip must be adjusted and positioned across the book to hold it in an open position.

Generally, the prior art book holders for holding a book in the open position are relatively complicated in design and operation and require adjustment when attached to a book.

It is desirable to produce an uncomplicated book holder for holding a book in the open position which does not require the reader to make adjustments or to use dexterity in attaching or using the book holder.

SUMMARY OF THE INVENTION

The present invention is directed to a book holder. In an aspect of the present invention, there is provided a flexible resilient book holder which permits an open book to be placed between a first and second planar surface keeping the pages on each side of the book in a relatively flat plane to permit the reader to read both pages. A book is defined herein to mean any reading material; in particular, any reading material with a spine in which the pages are attached to the spine. Furthermore, a book as defined herein includes, but is not limited to, a hardcover book, a softcover book, a manual, a pamphlet, a magazine, a phone book, a brochure, a commercial bank deposit book, and a catalogue.

In a further aspect of the present invention there is provided a book holder which has a first and second planar surface which are held at a relative distance from each other by a common base. The first planar surface is substantially a horizontal surface. The second planar surface is also a substantially horizontal surface. The common base is a substantially vertical wall extending from the second planar surface to the first planar surface. The splayed open book is placed in between the first planar surface and the second planar surface with the end of the book spine adjacent to the common base.

In a preferred embodiment of the present invention, the first planar surface of the book holder forms an angle of approximately 90 degrees from the common base and thereby permits the splayed book to be easily inserted into the book holder.

In a further aspect of the present invention, the first planar surface is in the shape of two wings wherein the central portion of the first planar surface is V-shaped with a wing or arm like configuration extending from each arm of the V-shape. At the base of the V-shape channel in the central portion of the first planar surface, the first planar surface is attached to the common base. The channel created between the two arms of the V-shape facilitates turning the pages of the book when the book is placed in the book holder.

In a preferred embodiment of the present invention, the second planar surface is a substantially rectangular surface that flares downwardly and inwardly to join the second planar surface to the common base.

In a further aspect of the present invention, the second planar surface extends upwardly from said common based to provide support to the back of a book when the book is placed in the book holder so that said book holder can be used in an upward position by attaching it to a suitable bracket.

In a further aspect of the present invention, the common base is flexible so that the first planar member can be pulled away from the splayed open book to facilitate page turning. In a preferred embodiment, the common base is corrugated. In a further preferred embodiment, the V-shaped channel of the first planar member extends to the common base so that one arm at a time can be pulled away from the splayed open book.

DESCRIPTION OF THE DRAWINGS

The following drawings are illustrations of preferred embodiments of the present invention but are in no way intended to limit the scope of the invention. Like reference numbers refer to like parts on the figures. The present invention will be described with reference to these figures.

As seen in FIGS. 1–4, the book holder 10 of the present invention comprises first and second spaced apart resilient planar members 12 and 14, respectively, and a common base 16.

The first and second planar members 12 and 14 are generally perpendicular to, or slightly diverging from perpendicular to, a resilient planar common base 16. The common base 16 is substantially vertical and resiliently holds said first and second planar members 12 and 14, respectively, in said spaced apart relation and substantially in a generally horizontal plane.

Figure 4:
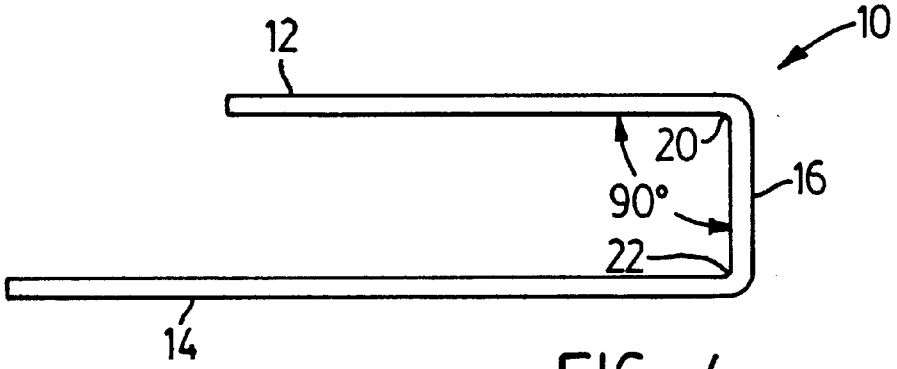
FIG. 4 is an illustration of a side view of the embodiment of the book holder of the present invention illustrated in FIG. 1.

The first planar member 12 is preferably at an angle of approximately 90 degrees from the common base 16 as shown in FIG. 4 so that the splayed open book is easily inserted into the book holder 10 without ripping or catching the pages on the book holder 10.

Further advantageously, first planar member 12 may be in the shape of a "whale tail", as seen in the depiction of the book holder 10 in the Figures. The "whale tail" is essentially comprised of a central portion which is V-shaped wherein each of the two arms of the V-shape form a wing shape. The central aperture, channel or indentation 24 in the central portion forming the V-shape separates the left and right wings 12*a* and 12*b* of first planar member 12. Indentation 24 allows left and right wings 12*a* and 12*b* to resiliently flex somewhat independently of each other. Book holder 10 thereby accommodates an open book 18. Specifically the "whale tail" or V-shape permits a book to be splayed open with different thicknesses on each side of the open book so that the book holder effectively splays open a book wherein the thickness 26*a* of the left half 18*a* of book 18 is different than the thickness 26*b* of the right half 18*b* of book 18 when book 18 and its spine 19 is centred relative to the indentation 24.

Figure 5:
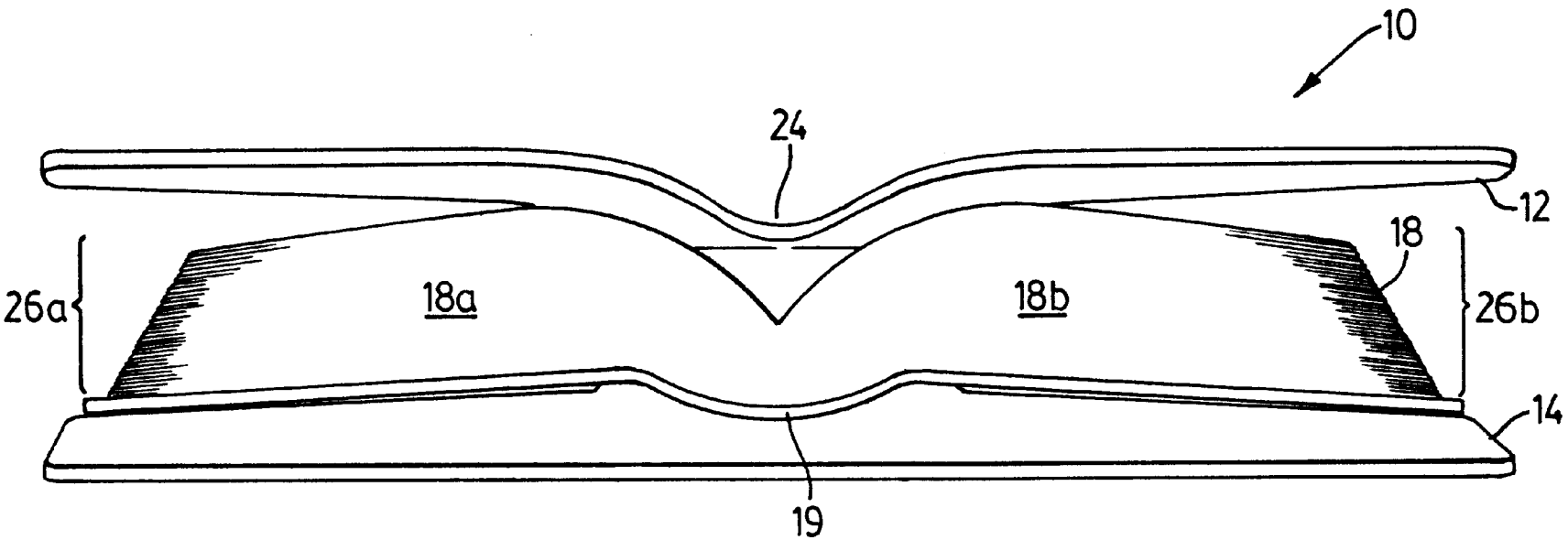
FIG. 5 is an illustration of a perspective view of the embodiment of the book holder of the present invention illustrated in FIG. 1 with a splayed open book.

As shown in FIGS. 5 and 6, a splayed open book 18 can be inserted into the book holder 10 so that the bottom or top of the book 18 is adjacent to the common base 16. If the bottom of the book 18 is adjacent to the common base 16, the common base 16 supports the bottom of the book 18. The common base 16 can vary in thickness depending on the thickness of the books which the book holder is designed to be used with. It has been observed that if the common base 16 is approximately ¾" between the first planar member 12 and the second planar member 14 books of varying sizes up to approximately 1¼" will be properly splayed open in the book holder 10.

The book holder 10 may be used with the bottom of the book 18 resting on the common base 16 or by inserting the top of the book 18 so that it is adjacent to the common base 16.

Figure 1:
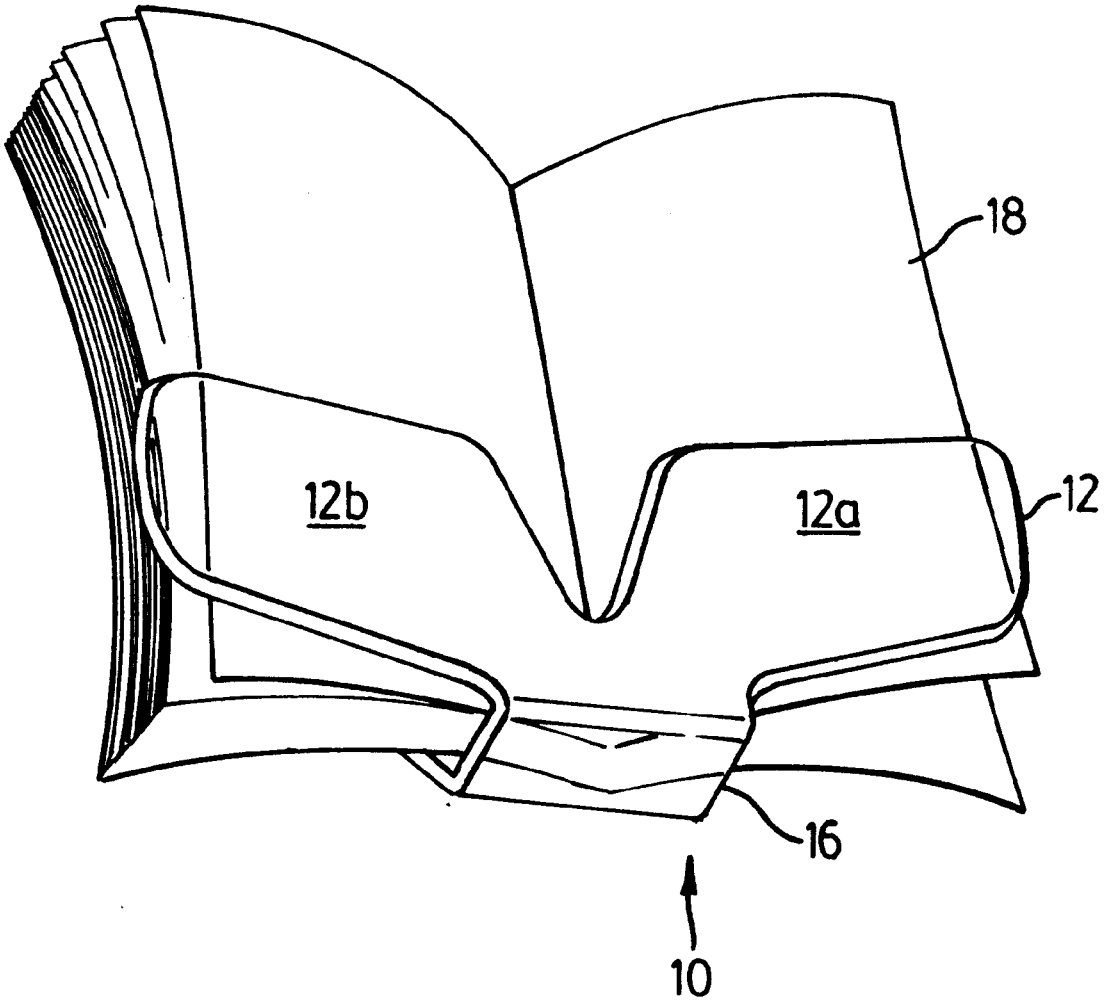
FIG. 1 is an illustration of a perspective view of an embodiment of the book holder of the present invention with a book splayed open.
Figure 3:
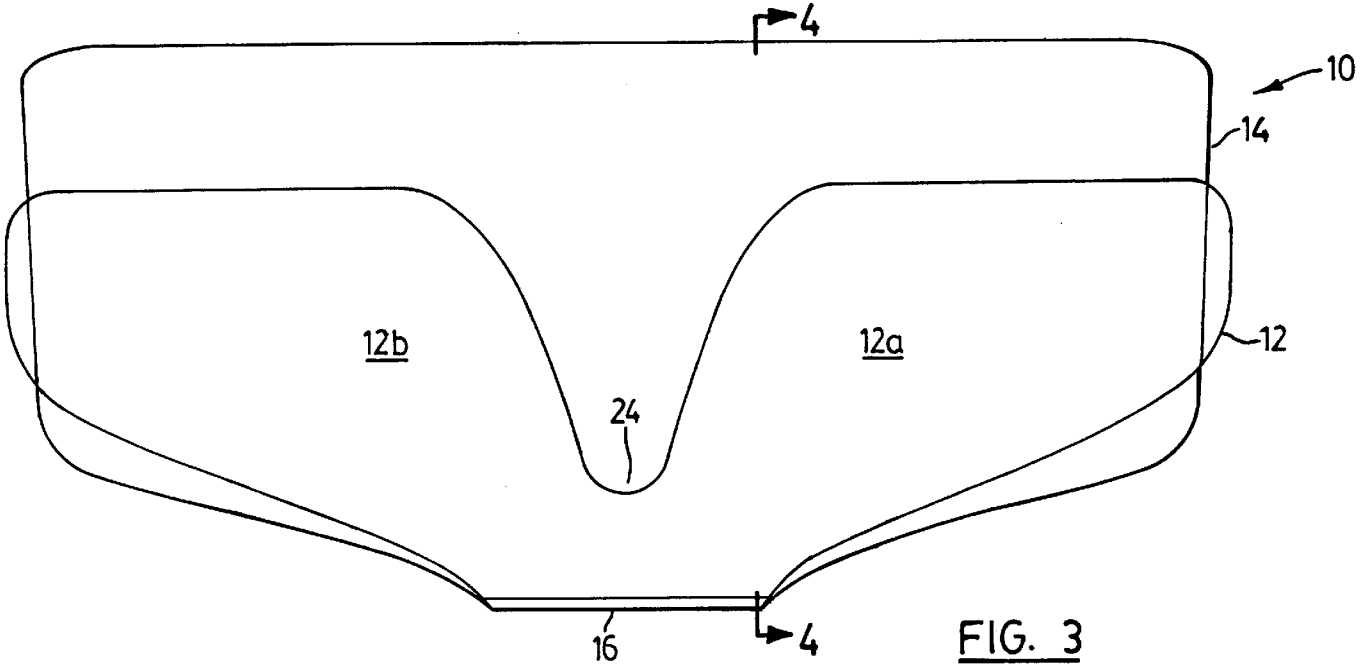
FIG. 3 is an illustration of a top view of the embodiment of the book holder of the present invention illustrated in FIG. 1.
Figure 2:
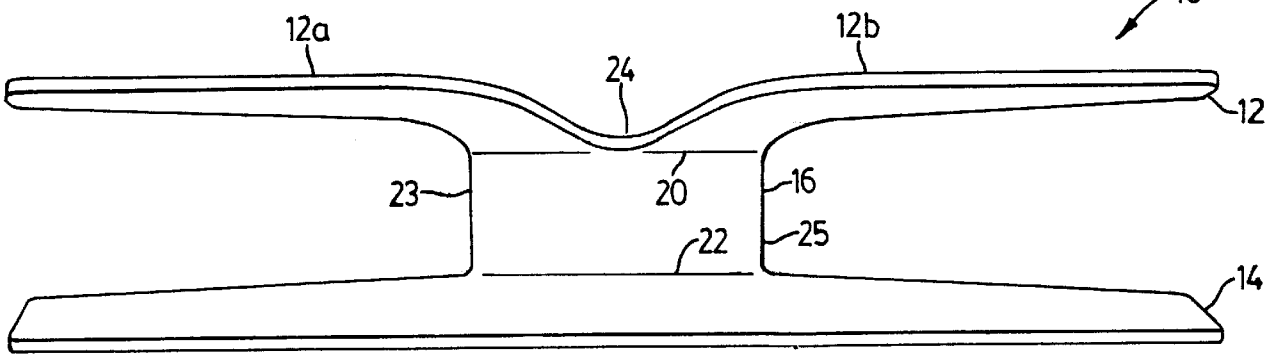
FIG. 2 is an illustration of a front view of the embodiment of the book holder of the present invention illustrated in FIG. 1

It has been observed that the book holder 10 works very effectively for a variety of book sizes. Since the book holder 10 operates such that the spine 19 of the book 18 is used to centre the book 18 in the book holder 10, the width and length of the book are irrelevant factors and are generally not adjusted for using the book holder 10. It has also been observed that when the width of the common base 16 between side 23 and side 25, as shown in FIG. 2, is approximately 1½" it accommodates the spines 19 of many books 18. However, this width can be adjusted for different spine sizes.

In an alternative embodiment, the book holder 10 could have an extensible third planar member extending from said second planar member 14 or a relatively larger second planar member 14 for supporting the back of a book 18 when said book holder 10 is in an upward position. In such an upward position said book holder 10 could be used with an attachment for a stationary bike, treadmill, or other exercise equipment or for a hospital table, wheelchair or bed. In a particular alternative embodiment, the book holder 10 could be used with an attachment for a kitchen cupboard door for use with a cook book.

In a further alternative embodiment, the common base 16 could be extremely flexible or corrugated to allow the first planar member 12 to be easily bent away from the splayed open book 18 to facilitate page turning without having to remove the book holder 10. In a preferred embodiment, for the corrugated common base 16, the V-shaped channel would reach the common base 12 to permit one wing or arm 12*a* or 12*b* to be bent downwards to facilitate page turning on one side of the book 18*a* or 18*b*, respectively.

The book holder 10 of the present invention maybe manufactured by injection moulding, heat folding or any other suitable process. In a preferred embodiment, the first and second planar members and the common base are transparent or translucent resilient material such as acrylic. When heat folding, first and second planar members 12 and 14, respectively, are folded contiguously along opposed corresponding first and second edges 20 and 22, respectively, to form a generally "U"-shaped device, such as seen in FIG. 4. The resilient "U"-shaped device may then be employed to resiliently splay open a book.

It is also desirable to manufacture the book holder 10 so that there are no sharp edges on which the pages in the book to be inserted will be ripped on. Injection moulding is very smooth minimizing sharp edges.

As will be apparent to those skilled in the art in the light of the foregoing disclosure, many alterations and modifications are possible in the practice of this invention without departing from the spirit or scope thereof.

I claim:

1. A book holder for maintaining a splayed book in an open position, said splayed book having a back, a spine, a first side and a second side, each of said sides having a plurality of pages biased towards each other, said book holder comprising:

a first planar member, said first planar member is in a substantially horizontal plane and said first planar member is generally whale-tail-shaped having a first wing and a second wing, each of said wings having a broad portion and a narrow portion, and a central base joining said narrow portion of said first wind and said narrow portion of said second wing, to define a V-shaped channel extending from said central base between said first wing and said second wing;

a second planar member, said second planar member is in a substantially horizontal plane;

a common base wherein said common base is joined to said central base and to said second planar member and said common base keeps said first planar member spaced apart from said second planar member such that when that said splayed book is inserted in between said first planar member and said second planar member, said first side abuts said first wing and said second side abuts said second wing to maintain said splayed book in said open position;

wherein said first planar member is approximately the same width as said second planar member and said second planar member is a substantially rectangular shape, and configured such that when said splayed book is inserted in between said first planar member and said second planar member, wherein said second member is adapted to support said back of said book.

2. A book holder as defined claim 1, wherein said first planar member is approximately 90 degrees from said common base.

3. A book holder as defined in claim 1, wherein said book holder is capable of holding said splayed open book, wherein said first side has a substantially different number of pages open on said first side than on said second side.

4. A book holder as defined in claim 1, wherein said book holder is attached to a bracket to keep said book holder in an upward position.

5. A book holder as defined in claim 1, wherein said book holder is comprised of a clear plastic material.

6. A book holder as defined in claim 5, wherein said book holder is comprised of acrylic.

7. A book holder as defined in claim 1, wherein said common base is flexible to allow said first planar member to be pulled away from said splayed open book to facilitate page turning.

8. A book holder as defined in claim 7, wherein said common base is corrugated.

9. A book holder as defined in claim 1, wherein each of said first wing and said second wing are substantially quadrangular.

10. A book holder for maintaining a splayed book in an open position, said splayed book having a back, a spine, a first side and a second side, each of said sides having a plurality of pages biased towards each other, said book holder comprising:

a first planar member, said first planar member is in a substantially horizontal plane and said first planar member is generally whale-tail-shape having a first wing and a second wing, each of said wings having a broad portion and a narrow portion, and a central base joining said narrow portion of said first wing and said narrow portion of said second wing, to define a V-shaped channel extending from said central base between said first wing and said second wing;

a second planar member, said second planar member is in a substantially horizontal plane;

a common base wherein said common base is joined to said central base and to said second planar member and said common base keeps said first planar member spaced apart from said second planar member such that when that said splayed book is inserted in between said first planar member and said second planar member, said first side abuts said first wing and said second side abuts said second wing to maintain said splayed book in said open position;

wherein said common base is substantially rectangular and said common base has a first and second side and said second planar member is substantially rectangular and said second planar member extends inwardly towards said first side of said common base wherein said second planar member is joined to said common base and said central base of said first planar member is joined to said second side of said common base.

* * * * *